United States Patent [19]

DeVilbiss

[11] Patent Number: 4,667,912

[45] Date of Patent: May 26, 1987

[54] COLLAPSIBLE RACK FOR FLEXIBLE BAGS

[76] Inventor: Charles E. DeVilbiss, 131 Oak, Bloomingdale, Ill. 60108

[21] Appl. No.: 840,879

[22] Filed: Mar. 18, 1986

[51] Int. Cl.[4] ..... A63B 55/04

[52] U.S. Cl. ..... 248/97; 248/150; 248/153

[58] Field of Search ..... 248/150, 99, 97, DIG. 7, 248/153, 167; 150/51; 15/257.9; 220/404; 53/390; 141/314, 391, 108; 232/43.2; 383/33

[56] References Cited

U.S. PATENT DOCUMENTS

| | | | |
|---|---|---|---|
| 3,603,541 | 9/1971 | Sturm | 248/97 |
| 3,633,859 | 1/1972 | Vosbikian | 248/97 |
| 3,826,455 | 7/1974 | O'Donnell | 248/99 X |
| 3,908,564 | 9/1975 | Miller et al. | 248/167 X |
| 4,196,880 | 4/1980 | Hynes | 248/99 |
| 4,281,813 | 8/1981 | Garrity | 248/97 |
| 4,299,507 | 11/1981 | Collins | 211/199 X |

*Primary Examiner*—J. Franklin Foss

[57] ABSTRACT

A collapsible wire form support or rack for flexible plastic bags consisting of two main vertical inverted "U" shaped supports interconnected at their bases by parallel rods, that collapses by rotating one support about a vertical axis relative to the other until both supports and rods are substantially coplanar.

10 Claims, 11 Drawing Figures

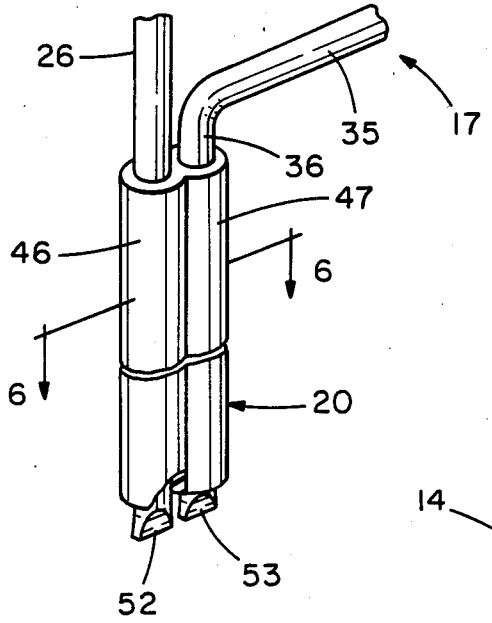
FIG.5
FIG.6
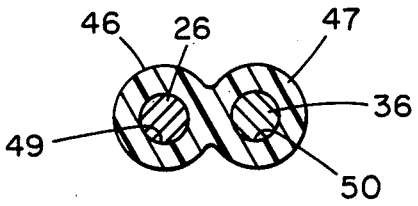
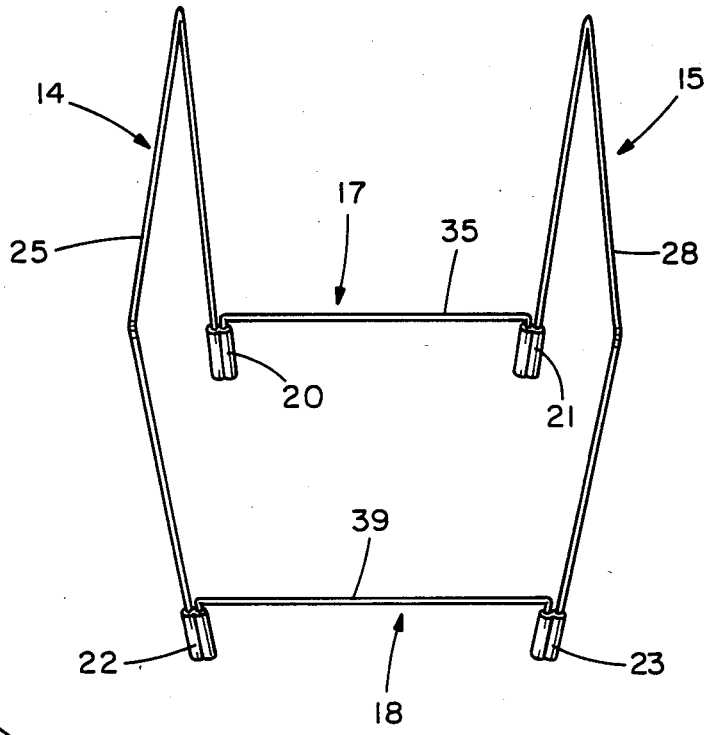
FIG.7
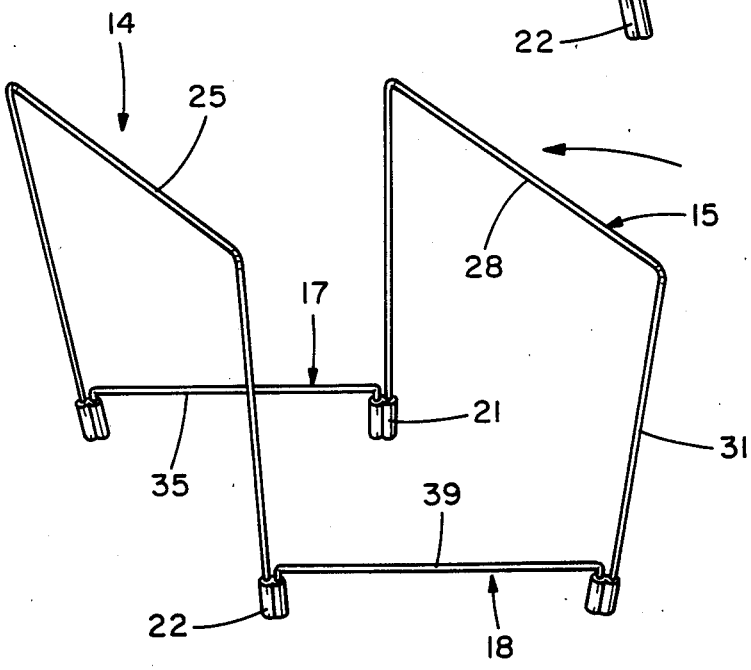
FIG.8

COLLAPSIBLE RACK FOR FLEXIBLE BAGS

BACKGROUND OF THE INVENTION

Flexible plastic containers have found considerable commercial success over the last several decades for storing and transporting refuse and disposables such as garbage, lawn clippings, leaves, as well as many types of commercial and industrial wastes. These containers have wall thicknesses on the order of 0.001 to 0.004 inches which makes them incapable of supporting themselves either in an open or a vertically erect position, so that it has usually been found necessary to either manually hold the bag open during loading or to use the bag as a liner for another rigid type container such as a rigid plastic or metal waste container.

The use of a secondary rigid container as a support has several disadvantages. These rigid containers in addition to being costly and heavy relative to the flexible containers, occupy considerable space when not in use. Another disadvantage is that the rigid containers, when lined, are essentially sealed by the flexible containers after filling, making the filled flexible container difficult to remove because of the suction effect created as the flexible container is being withdrawn from the rigid container.

Because of these problems there have been attempts to construct flexible bag supports from rods and wire members and some of these have been collapsible. For example, a plurality of collapsible bag stands or supports are constructed of wire forms with two inverted "U" shaped side wires. These are exemplified in the Valesko U.S. Pat. Nos. 4,364,534 and 4,469,300 and the Stroh U.S. Pat. No. . 4,467,989. In these bag stands the side wires fold toward and away from one another to achieve collapsing and set up, and the net result of this is that in the collapsed position the entire unit is larger in outside dimension than the individual side wires and this is a disadvantage in storage, although principally in shipping. Furthermore, these bag racks all require four bottom wires.

In the Vosbikian U.S. Pat. No. 3,633,859 a bag rack is shown having two inverted "U" shaped sides connected to two crossed "U" shaped bottom rods. The rack is not at all collapsible because of the crossed relation of its bottom rods 20 and 21 as well as the fact that they are pinned together centrally by a fastener 28.

The Champlin U.S. Pat. No. 1,971,642 shows a rack somewhat similar to the Vosbikian patent described above, except that it is collapsible into a single plane. However, the Champlin bag holder does not have top wires.

The Sturm U.S. Pat. No. 3,603,541 shows a collapsible bag rack where the rack collapses by bringing opposite corners together. This construction requires four bottom wires, four top wires and four side wires and is thus considerably complex.

Other patents showing tubular type bag stands are shown in U.S. Pat. Nos. 996,421, 2,783,010, 2,328,739 4,031,689, 3,836,037, 3,826,455, 3,161,391, 2,731,184, 4,487,388, 4,458,867, 4,299,365, 4,174,085, 4,372,512, 3,960,351 and 2,470,977.

SUMMARY OF THE PRESENT INVENTION

According to the present invention a collapsible wire form support or rack is provided for flexible plastic bags that consists of two main vertical inverted "U" shaped wire supports interconnected at their bases by horizontal rods, that collapses into essentially a single plane by the user by grasping one support in each hand at the top and rotating one about a vertical axis relative to the other until both supports and rods are substantially coplanar.

Toward this end the supports and rods have equal horizontal widths, the inveerted "U" shaped supports are parallel to one another in the active or erected position, and the rods are parallel to each other in the active position. Each rod is pivotally connected at its ends about vertical axes substantially coaxial with one leg of each vertical "U" shaped support. In this way and when viewed from the top, the rack forms essentially a square that during initial collapsing movement shifts into a parallelogram of decreasing height, and upon further rotation of one support relative to the other about a vertical axis the two supports are approximately 90 degrees to one another (still viewed from the top), with one interconnecting rod coplanar with one support and the other interconnecting rod coplanar with the other support. This is the midway position in the collapsing process. Upon further rotation of one of the supports in the same direction, i.e. either counterclockwise or clockwise with respect to the other, the one rod remains coplanar with the one support and the other rod remains coplanar with the other support and the supports move angularly toward one another until both supports and rods are substantially coplanar in the fully collapsed position.

The wire form container support according to the present invention is far less costly than presently known wire form flexible container supports and has the decided advantage that it can be collapsed and erected by grasping the top wire of the inverted "U" shaped supports without requiring any user bending, and when collapsed it attains a more fully coplanar configuration than in any heretofore known wire form flexible container support.

A still further advantage of the present collapsible wire form support is that it can be completely assembled at the manufacturing location and requires no assembly whatsoever by the user.

Other objects and advantages will become apparent from the following detailed description of the invention.

BRIEF DESCRIPTION OF THE DRAWINGS

FIG. 5 is an enlarged fragmentary view of one of the plastic pivot bosses interconnecting one of the cross rods to one of the "U" shaped supports;

FIG. 6 is a cross-section of one of the pivot bosses taken generally along line 6—6 of FIG. 5; and FIGS. 7 to 11 are perspective views of the present wire form container support shown successively from a fully erected position to a fully collapsed position in FIG. 11.

DETAILED DESCRIPTION OF THE PREFERRED EMBODIMENT

Figure 1:
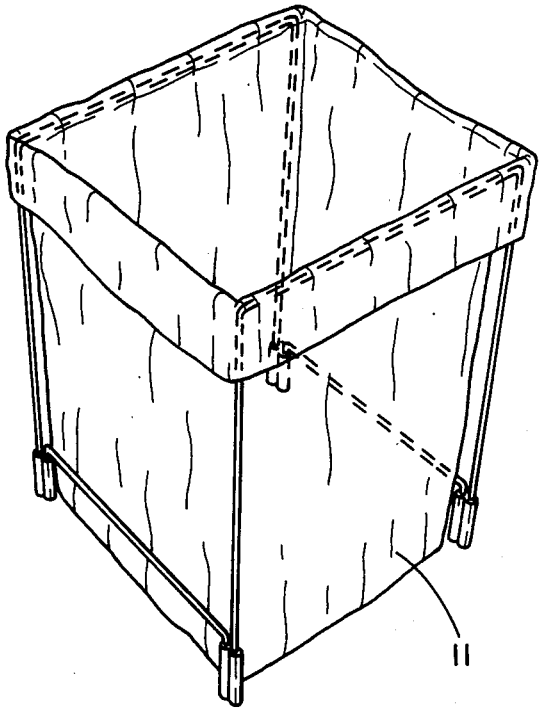
FIG. 1 is a perspective view of the present collapsible wire form rack supporting an exemplary flexible plastic container.
Figure 2:
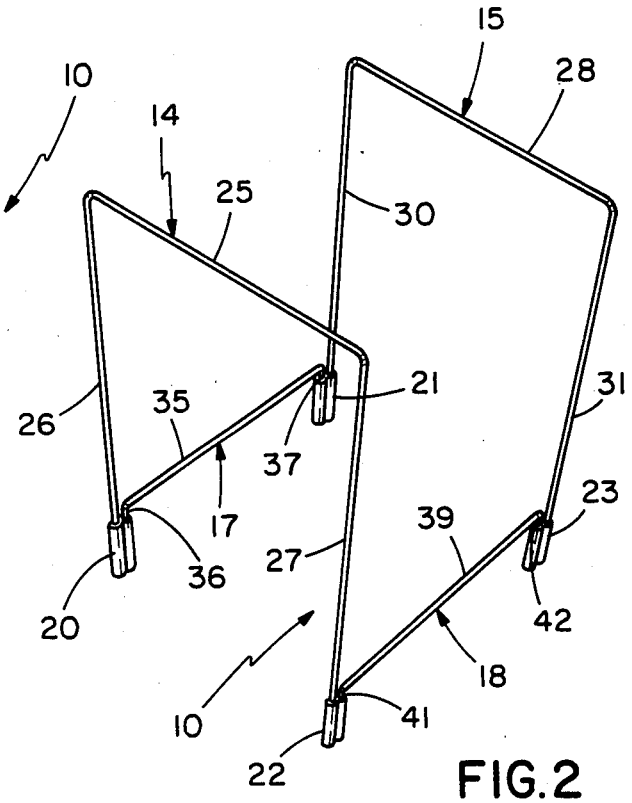
FIG. 2 is a perspective view of the wire form support illustrated in FIG. 1 with the support rotated 90 degrees from the FIG. 1 position.
Figure 3:
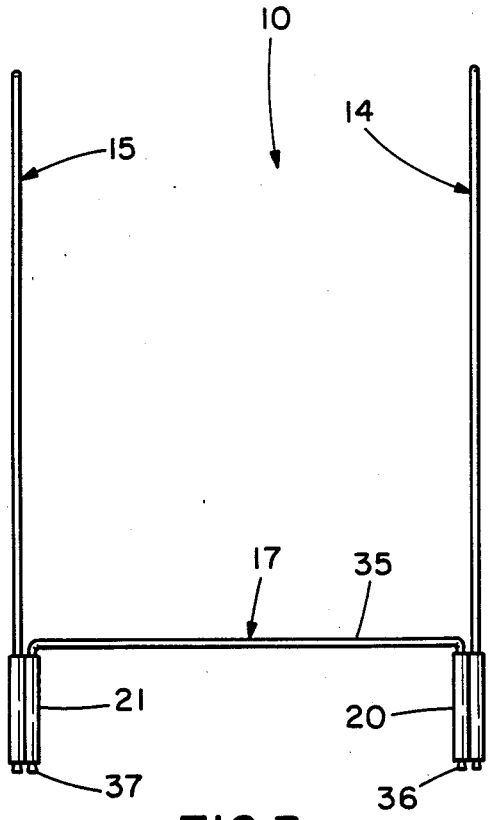
FIG. 3 is a front view of the wire form support illustrated in Figs. 1 and 2.
Figure 4:
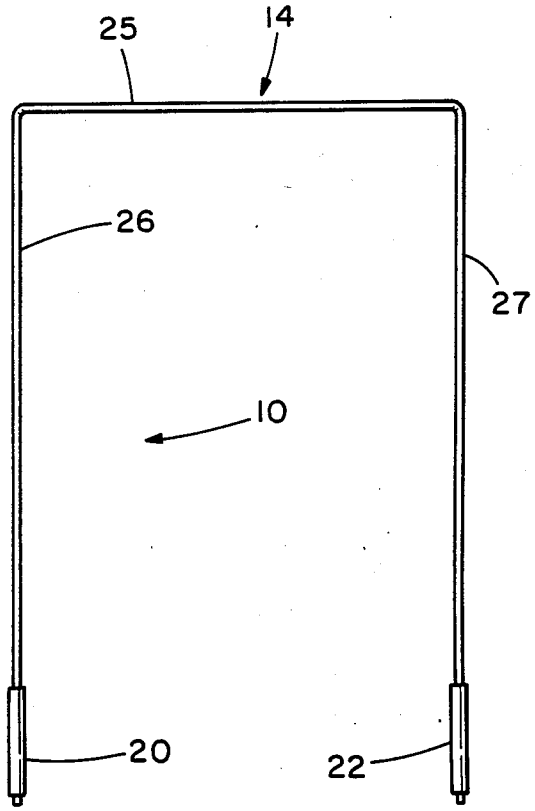
FIG. 4 is a side view of the wire form support illustrated in FIG. 3.

Referring to the drawings and particularly FIGS. 1 to 6, a collapsible wire form support or rack 10 is illustrated for commercially available flexible plastic containers 11. The rack 10 may be manufactured in a plurality of sizes to accommodate various sizes of plastic containers 11 as willbe appreciated by those skilled in the marketing of these container products.

Rack 10 generally includes inverted "U" shaped supports 14 and 15 interconnected by short legged cross rods 17 and 18 with pivot bosses 20, 21, 22 and 23.

The supports 14 and 15 and rods 17 and 18 are preferably constructed of plated solid ferrous rods on the order of 3/16" to ¼" diameter although somewhat heavier rod may also be utilized at a corresponding increase in cost, if desired.

Support 14 includes a horizontal upper cross piece 25 and vertically downwardly extending leg portions 26 and 27, and identical support 15 includes horizontal upper cross piece 28 and downwardly extending leg portions 30 and 31.

The cross rod 17 includes horizontal portion 35 with downwardly extending leg portions 36 and 37, and identical cross rod 18 includes a horizontal portion 39 and vertically downwardly extending leg portions 41 and 42.

An important aspect of the present invention to achieve the desired collapsing action is that the upper horizontal cross peices 25 and 28 of the supports 14 and 15, and the horizontal portions 35 and 39 of the interconnecting cross rods 17 and 18 are all approximately the same length so that when viewed from the top in the erected position illustrated in FIGS. 2, 3, 4 and 7 the assembly 10 appears essentially as a square. The length of the vertical leg portions 26, 27, 30 and 31 is determined by the desired height for the top of the flexible bag 11 and of course, the bag 11 is supported by holding the upper portion of the bag over the cross pieces 25 and 28 of the supports 14 and 15 respectively, permitting the body of the container to open between the cross rods 17 and 18, as shown in FIG. 1.

Each of the bosses 20 is identical and as best seen in FIGS. 6, is a one-piece plastic extrusion including a first tubular portion 46 integrally formed with a second tubular portion 47. Tubular portions 46 and 47 have through-bores 49 and 50 therein that receive respectively the legs of supports 14 and 15 and the legs of cross rods 17 and 18, and in the case of FIGS. 5 and 6 leg portions 26 and 36. The bosses permit the free pivotal movement of the legs in bores 49 and 50 but have some frictional engagement therewith to give stability to the overall assembly, particularly in the active or erect position of the assembly. As seen in FIG. 5, leg ends 52 and 53 project from the boss bores 49 and 50 at each of the bosses and are deformed slightly to retain the bosses in the axial positions illustrated in the drawings.

The procedure and method of collapsing the present wire form rack is illustracted in FIGS. 7 to 11 with the rack illustrated in FIG. 7 in its active position directly in front of the user as it would appear with the user standing and looking downwardly at the rack positioned slightly in front of him. The user initially grasps the cross pieces 25 and 28 with the right and left hands respectively with the arms parallel to one another and the wrists fairly straight. The rack is collapsed by rotating one or both of the supports 14 and 15 relative to the other about vertical axes. If both supports 14 and 15 are rotated they are rotated in opposite directions somewhat out of phase with respect to each other, i.e. first rotating one support and thereafter rotating the other. In FIGS. 7 to 11, however, and for the sake of simplifying the understanding and mechanics of collapsing, the support 14 remains essentially stationary and the support 15 and the cross rods 17 and 18 are pivoted with respect thereto during collapsing, but it should be understood that both supports 14 and 15 may move during the collapsing movement.

Figure 9:
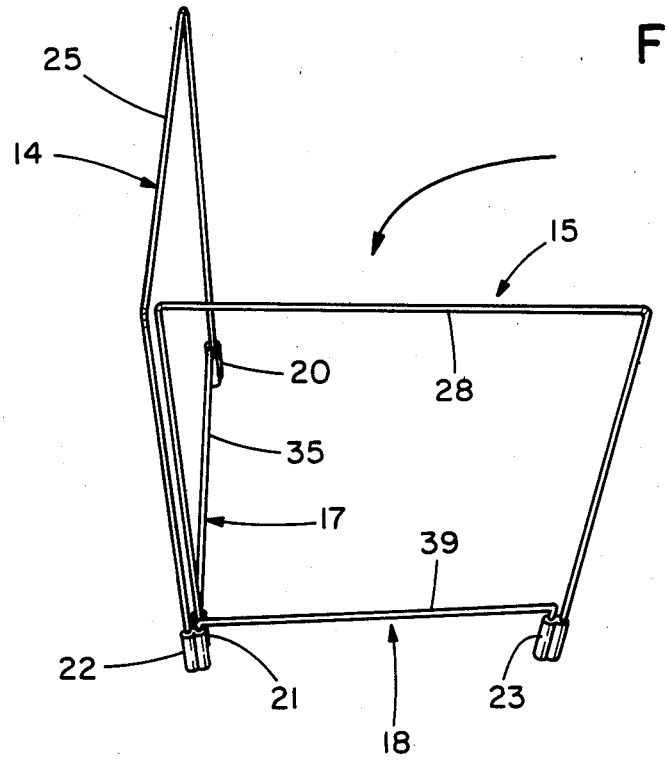
Figure 10:
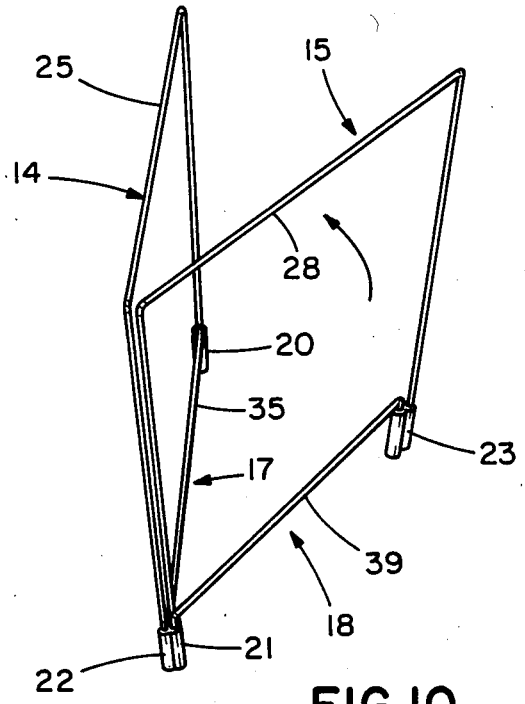

In initial collapsing movement and as seen in FIG. 8, the right hand pivots the support 15 in a counterclockwise direction about a vertical axis generally defined by leg portion 31 and during this movement, the supports 14 and 15 and cross rods 17 and 18 when viewed from the top appear as a decreasing parallelogram. Upon further counterclockwise rotation of the support 15 by the user's right hand, pivot boss 21 moves toward and eventually engages pivot boss 22 as seen in FIG. 9, and in this position the supports 14 and 15 are substantially at right angles to one another while cross rod 17 moves to a position substantially coplanar with support 14 and cross rod 18 moves to a position substantially coplanar with support 15. The user then continues the counterclockwise rotation of support 15 with his right hand from the position shown in FIG. 9 through the position shown in FIG. 10, moving boss 23 toward boss 20 until it engages boss 20 in the fully collapsed position shown in FIG. 11. In this position, supports 14 and 15 as well as cross rods 17 and 18 are all substantially coplanar.

In this collapsed position the rack 10 can be easily hung from a supporting bracket or nail on the wall without occupying any significant space.

Figure 11:
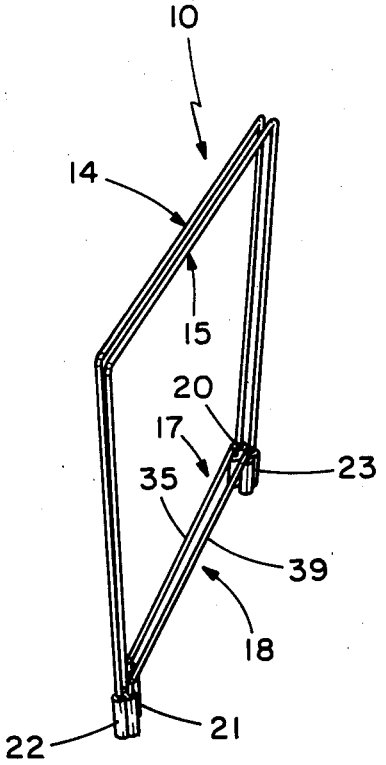

The rack 10 is erected or moved to its active position simply by the reverse procedure, rotating the support member 15 in a clockwise direction from its position shown in FIg. 11 with the left hand holding support 14.

While the collapsing procedure has been described above in stages it should be understood that it actually takes but a fraction of a second to achieve either collapsing or erection of the present container or rack.

I claim:

1. A flexible bag collapsible support assembly comprising: a first generally "U" shaped support, a second generally "U" shaped support parallel and spaced from the first "U" shaped support in the erected position of the assembly, each of said "U" shaped supports having first and second vertically extending legs, first means spacing and pivotally connecting the first legs of the first and second supports, and second means spacing and pivotally connecting the second legs of the first and second supports, said "U" shaped supports being constructed and connected so that the assembly may be collapsed by rotating one of the spaced and parallel "U" shaped supports substantially 180 degrees about an axis parallel and relative to the other "U" shaped support until the two "U" shaped supports are substantially in alignment and coplanar.

2. A flexible bag collapsible support assembly as defined in claim 1, wherein the first means connecting the first legs is substantially parallel to the second means connecting the second legs in the erected position of the assembly, said "U" shaped supports being unconnected at their open ends.

3. A flexible bag collapsible support assembly as defined in claim 1, wherein the first means connecting the first legs includes a first rod pivotally connected to the first leg of one support about an axis substantially coaxial with the first leg of the one support and pivotally connected to the first leg of the other support about an axis substantially coaxial with the first leg of the other support, said second means connecting the second legs including a second rod pivotally connected to the second leg of one support about an axis substantially coaxial with the second leg of the one support and pivotally connected to the second leg of the other support about an axis substantially coaxial with the second leg of the other support.

4. A flexible bag collapsible support assembly as defined in claim 1, wherein the first means connecting the first legs includes a rod interconnecting the first legs and having a length substantially equal to the width of the first and second supports, said second means interconnecting the second legs including a rod interconnecting the second legs and having a length substantially equal to the width of the first and second supports, said first and second rods being substantially spaced and parallel in the erected position of the assembly and directly adjacent, aligned and parallel in the collapsed position of the assembly.

5. A flexible container support assembly movable from a collapsed position to an active position, comprising: a first generally vertical planar member having a top portion over which the container is supported, a second generally vertical planar member having a top portion over which the container is supported, means connecting the planar members together to support them in spaced parallel relation when the assembly is in an active position, and said means interconnecting the planar members constructed to permit one planar member to be pivoted about an axis substantially vertical and parallel to its own plane approximately 180 degrees relative to the other planar member to the collapsed position with the planar members directly adjacent and aligned with one another.

6. A flexible container support assembly as defined in claim 5, wherein either or both planar members may be pivoted about a vertical axis parallel to its own plane to effect collapsing.

7. A flexible container support assembly as defined in claim 5, wherein the means interconnecting the first and second planar members includes a first horizontal rod pivotally connected about a vertical axis to the first planar member and pivotally connected about a vertical axis to the second planar member, and a second horizontal rod pivotally connected about a vertical axis to said first planar member and pivotally connected to the second planar member about a vertical axis.

8. A flexible container support assembly as defined in claim 8, including a first pivot member interconnecting the first rod and the first planar member, a second pivot member interconnecting the first rod and the second planar member, a third pivot member interconnecting the second rod and the first planar member, and a fourth pivot member inter-connecting the second rod and the second planar member.

9. A flexible bag collapsible wire form support assembly, comprising: a first inverted "U" shaped support having first and second downwardly extending legs, a second inverted "U" shaped support having first and second downwardly extending legs, means pivotally connecting the first legs together and means pivotally connecting the second legs together so that the legs all remain substantially parallel as the assembly is moved from a collapsed position to an active position with the first "U" shaped support substantially parallel to and spaced from the second "U" shaped support, said first and second legs of each support being unconnected at their lower ends to permit the support assembly to be collapsed to a position where one support is directly adjacent, aligned and parallel to the other support.

10. A flexible bag collapsible wire form support as defined in claim 9, wherein the means pivotally connecting the first legs includes a first horizontal rod with downwardly turned ends, a pivot assembly connecting each rod end to one of the first legs about axes substantially coaxial with the first legs, said means pivotally connecting connecting said second legs including a second horizontal rod with downturned ends, and a pivot assembly connecting each second rod end to the second legs about axes substantially coaxial with the second legs.

* * * * *